US005434827A

United States Patent [19]

Bolorforosh

[11] Patent Number: 5,434,827

[45] Date of Patent: Jul. 18, 1995

[54] MATCHING LAYER FOR FRONT ACOUSTIC IMPEDANCE MATCHING OF CLINICAL ULTRASONIC TRANDUCERS

[75] Inventor: Mir S. S. Bolorforosh, Palo Alto, Calif.

[73] Assignee: Hewlett-Packard Company, Palo Alto, Calif.

[21] Appl. No.: 77,530

[22] Filed: Jun. 15, 1993

[51] Int. Cl.[6] ..... H04R 17/00

[52] U.S. Cl. ..... 367/140; 367/152; 367/155; 367/157; 310/320; 128/662.03

[58] Field of Search ..... 367/152, 157, 155, 140; 310/320; 128/662.03

[56] References Cited

U.S. PATENT DOCUMENTS

| | | | |
|---|---|---|---|
| 3,718,898 | 2/1973 | Cook et al. | 367/157 |
| 3,833,825 | 9/1974 | Haan | 310/8 |
| 4,211,948 | 7/1980 | Smith et al. | 310/322 |
| 4,462,092 | 7/1984 | Kawabuchi et al. . | |
| 4,672,591 | 6/1987 | Breimesser et al. | 367/152 |
| 4,717,851 | 1/1988 | Fenner et al. | 310/334 |
| 5,045,746 | 9/1991 | Wersing et al. | 310/334 |
| 5,099,459 | 3/1992 | Smith | 367/153 |
| 5,115,809 | 5/1992 | Saitoh et al. | 128/662.03 |
| 5,142,187 | 8/1992 | Saito et al. | 310/358 |
| 5,175,709 | 12/1992 | Slayton et al. | 367/90 |
| 5,237,542 | 8/1993 | Burke et al. | 367/103 |

FOREIGN PATENT DOCUMENTS 90305961 5/1990 European Pat. Off. .

OTHER PUBLICATIONS

Wallace A. Smith, "Modeling 1-3 Composite Piezoelectrics: Thickness-Mode Oscillations," Jan. 1991, pp. 40–47.

R. E. Newnham et al., "Connectivity And Piezoelectric-Pyroelectric Composites," 1978, pp. 525–536.

M. I. Haller et al., "Micromachined acoustic matching layers," Jul. 21, 1992 pp. 72–77.

M. I. Haller et al., "Micromachined Ultrasonic Materials," 1991, pp. 403–405.

G. S. Kino, "Acoustic Waves," pp. 41–45.

*Primary Examiner*—J. Woodrow Eldred

[57] ABSTRACT

An ultrasonic probe having one or more piezoelectric ceramic elements, each having a respective bulk acoustic impedance. Each element has a respective front face and a respective piezoelectric ceramic layer integral therewith to provide efficient acoustic coupling between the probe and a medium under examination by the probe. The respective piezoelectric layer of each element includes shallow grooves disposed on the respective front face of each piezoelectric element. A groove volume fraction of the piezoelectric layer is selected to control acoustic impedance of the piezoelectric layer so as to provide a desired acoustic impedance match between the bulk acoustic impedance of the element and an acoustic impedance of a medium under examination by the probe. Electrodes extend into and contact the grooves, imposing electrical boundary requirements that support a desired electrical field distribution within the element.

21 Claims, 12 Drawing Sheets

MATCHING LAYER FOR FRONT ACOUSTIC IMPEDANCE MATCHING OF CLINICAL ULTRASONIC TRANDUCERS

BACKGROUND OF THE INVENTION

The present invention generally relates to ultrasonic probes and more specifically to ultrasonic probes for acoustic imaging.

Ultrasonic probes provide a convenient and accurate way of gathering information about various structures of interest within a body being analyzed. In general, the various structures of interest have acoustic impedances that are different than an acoustic impedance of a medium of the body surrounding the structures. In operation, such ultrasonic probes generate a broadband signal of acoustic waves that is then acoustically coupled from the probe into the medium of the body so that the acoustic signal is transmitted into the body. As the acoustic signal propagates through the body, part of the signal is reflected by the various structures within the body and then received by the ultrasonic probe. By analyzing a relative temporal delay and intensity of the reflected acoustic waves received by the probe, a spaced relation of the various structures within the body and qualities related to the acoustic impedance of the structures can be extrapolated from the reflected signal.

For example, medical ultrasonic probes provide a convenient and accurate way for a physician to collect imaging data of various anatomical parts, such as heart tissue or fetal tissue structures within a body of a patient. In general, the heart or fetal tissues of interest have acoustic impedances that are different than an acoustic impedance of a fluid medium of the body surrounding the tissue structures. In operation, such a medical probe generates a broadband signal of acoustic waves that is then acoustically coupled from a front portion of the probe into the medium of the patient's body, so that the signal is transmitted into the patient's body. Typically, this acoustic coupling is achieved by pressing the front portion of the probe into contact with a surface of the abdomen of the patient. Alternatively, more invasive means are used, such as inserting the front portion of the probe into the patient's body through a catheter.

As the acoustic signal propagates through the patient's body, portions of the signal are weakly reflected by the various tissue structures within the body and received by the front portion of the ultrasonic medical probe. As the weakly reflected acoustic waves propagate through the probe, they are electrically sensed by electrodes coupled thereto. By analyzing a relative temporal delay and intensity of the weakly reflected waves received by the medical probe, imaging system components that are electrically coupled to the electrodes extrapolate an image from the weakly reflected waves to illustrate spaced relation of the various tissue structures within the patient's body and qualities related to the acoustic impedance of the tissue structures. The physician views the extrapolated image on a display device coupled to the imaging system.

Since the acoustic signal is only weakly reflected by the tissue structures of interest, it is important to try to provide efficient acoustic coupling between the front portion of probe and the medium of the patient's body. Such efficient acoustic coupling would insure that strength of the acoustic signal generated by the probe is not excessively diminished as the signal is transmitted from the from portion of the probe into the medium of the body. Additionally, such efficient acoustic coupling would insure that strength of the weakly reflected signal is not excessively diminished as the reflected signal is received by the front portion of the probe from the medium of the body. Furthermore, such efficient acoustic coupling would enhance operational performance of the probe by reducing undesired reverberation of reflected acoustic signals within the probe.

An impediment to efficient acoustic coupling is an acoustic impedance mis-match between an acoustic impedance of piezoelectric materials of the probe and an acoustic impedance of the medium under examination by the probe. For example, one piezoelectric material typically used in ultrasonic probes is lead zirconate titanate, which has an acoustic impedance of approximately $33\times10^6$ kilograms/meter$^2$second, kg/m$^2$s. The acoustic impedance of lead zirconate titanate is poorly matched with an acoustic impedance of human tissue, which has a value of approximately $1.5\times10^6$ kg/m$^2$s.

Previously known acoustic coupling improvement schemes have had only limited success and have created additional manufacturing, reliability and performance difficulties. For example, one previously known scheme provides an ultrasonic probe of high-polymer piezoelectric elements. Each of the high-polymer piezoelectric elements comprises a composite block of piezoelectric and polymer materials. For example, FIG. 1 is a cross sectional view of a typical piezoelectric composite transducer. As shown, a single piezoelectric ceramic plate is reticulately cut to be finely divided, so that a number of fine pole-like piezoelectric ceramics 1 are arranged two-dimensionally. A resin 7 including microballoons (hollow members) 6 is cast to fill in gaps between piezoelectric ceramic poles 1. The resin is cured so as to hold the piezoelectric ceramic poles 1. Electrodes 4, are provided on both end surfaces of the piezoelectric ceramic poles 1 and the resin 7, so as to form the piezoelectric ceramic transducer. The piezoelectric composite transducer shown in FIG. 1 is similar to one discussed in U.S. Pat. No. 5,142,187 entitled "Piezoelectric Composite Transducer For Use in Ultrasonic Probe" and issued to Saito et al. Because this patent provides helpful background information concerning piezoelectric composites, it is incorporated herein by reference.

While composite materials provide some improved acoustic coupling to various desired media, there are difficulties in electrically sensing reflected acoustic waves received by such composites. A dielectric constant of each high polymer element is relatively small. For example, for a composite that is 50% polymer and 50% piezoelectric ceramic, the dielectric constant measurable between electrodes of the high polymer element is approximately half of that which is inherent to the piezoelectric ceramic. Accordingly, the dielectric constant measurable between the electrodes of the high polymer element is only approximately 1700. A much higher dielectric constant is desirable so that a higher capacitive charging is sensed by the electrodes in response to the reflected acoustic waves. The higher dielectric constant would also provide an improved electrical impedance match between the probe and components of the imaging system electrically coupled to the probe.

Another previously known acoustic coupling improvement scheme provides an ultrasonic probe comprising one or more layers of dissimilar matching materials bonded to a front portions of a piezoelectric vibrator body. A thin layer of a cement adhesive is applied to bond each layer, thereby creating undesirable adhesive bond lines between the layers of dissimilar materials and the piezoelectric body.

For example, FIG. 2 illustrates an ultrasonic transducer 202 comprising an acoustically damping support body 204 of epoxy resin having an acoustic impedance of $3\times10^6$ kilograms/meter$^2$second, kg/m$^2$s, a piezoelectric vibrator body 206 of a piezoceramic, such as lead zirconate titanate having the acoustic impedance of $33\times10^6$ kg/m$^2$s, a silicon layer 208 having an acoustic impedance of $19.5\times10^6$ kg/m$^2$s, and a polyvinylidene fluoride layer 210 having an acoustic impedance of **4 * 106 kg/m$^2$s. The silicon and polyvinylidene fluoride layers are used to match the relatively high acoustic impedance of the piezoceramic material of the vibrator body to a relatively low acoustic impedance of human tissue, which has an acoustic impedance of $1.5\times10^6$ kg/m$^2$s. The vibrator body 206** shown in FIG. 2 has a resonant frequency of 20 megahertz, MHz, and the silicon and polyvinylidene fluoride layers each have a respective thickness that is a quarter wave length of the resonant frequency of the vibrator body.

Electrodes (not shown in FIG. 2) are electrically coupled to the vibrator body 206 for electrically sensing acoustic signals received by the transducer. Unlike the piezoelectric composite discussed previously herein, the piezoceramic material of the vibrator body 206 has a relatively high dielectric constant, which is not degraded by polymer. For example, lead zirconate titanate has a relatively high intrinsic dielectric constant of approximately 3400.

The piezoelectric vibrator body 206 shown in FIG. 2 is connected on one side to the acoustically damping support body 204 by means of an adhesive layer over a large area, and is attached on an opposite side at least indirectly to the silicon layer 208 by another adhesive layer. Similarly, the polyvinylidene fluoride layer 210 is connected to silicon layer by yet another adhesive layer. The thickness of each adhesive layer is typically 2 microns. The ultrasonic transducer 202 shown in FIG. 2 is similar to one discussed in U.S. Pat. No. 4,672,591 entitled "Ultrasonic Transducer" and issued to Briesmesser et al. Because this patent provides helpful background information concerning dissimilar matching materials bonded to piezoelectric bodies, it is incorporated herein by reference. Though the dissimilar layers employed in previously known schemes help to provide impedance matching, the adhesive bonding of these layers creates numerous other problems. A plurality of bonding process steps needed to implement such schemes creates manufacturing difficulties. For example, during manufacturing it is difficult to insure that no voids or air pockets are introduced to the adhesive layer to impair operation of the probe. Furthermore, reliability of this previously known transducers is adversely effected by differing thermal expansion coefficients of the layers of dissimilar materials and the piezoelectric block. Over time, for example over 5 years of use, some of the adhesive bonds may lose integrity, resulting in "dead" transducer elements that do not effectively transmit or receive the acoustic signals. Additionally, operational performance is limited at higher acoustic signal frequencies, such as frequencies above 20 megahertz, by the bond lines between the piezoelectric body and the dissimilar materials.

One measure of such operational performance limitations is protracted ring down time in impulse response of the ultrasonic transducer of FIG. 2. Such impulse response can be simulated using a digital computer and the KLM model as discussed in "Acoustic Waves" by G. S. Kino on pages 41–45, which is incorporated herein by reference. FIG. 3 is a diagram of the simulated impulse response of the ultrasonic transducer of FIG. 1 having the resonant frequency of 20 Megahertz, radiating into water, and constructed in accordance with the principles taught by Briesmesser et al. In accordance with the impulse response diagram shown in FIG. 3, simulation predicts a −6 decibel, db, ring down time of 88.637 nanoseconds, nsec, a −20 db ring down time of 270.411 nsec, and a −40 db ring down time of 452.350 nsec.

What is needed is a reliable ultrasonic probe that provides enhanced operational performance and efficient electrical coupling to imaging system components, while further providing efficient acoustic coupling to the desired medium under examination by the probe.

SUMMARY OF THE INVENTION

An ultrasonic probe of the present invention provides efficient and controlled acoustic coupling to a desired medium under examination by the probe and further provides for efficient electrical coupling to electrodes for electrically exciting and sensing acoustic signals that are transmitted and received by the probe. Furthermore, the present invention is not limited by manufacturing, reliability and performance difficulties associated with previously known acoustic coupling improvement schemes that employ adhesive cements to bond layers of dissimilar acoustic materials to piezoelectric ceramics.

Briefly and in general terms, the ultrasonic probe of the present invention employs one or more piezoelectric ceramic elements, each having a respective bulk acoustic impedance. A respective pair of the electrodes is coupled to each element. Preferably, the piezoelectric elements are arranged in a one or two dimensional phased array. Each element has a respective front face and a respective piezoelectric ceramic layer integral therewith for substantially providing a desired acoustic impedance match between the bulk acoustic impedance of the element and an acoustic impedance of the medium under examination. For electrical potential measurable between the respective pair electrodes, there is relatively little electrical potential difference along a respective thickness of the respective layer. Accordingly, the respective piezoelectric layer is substantially electromechanically inert. Each element further includes a respective bulk remainder portion that is electromechanically active and resonates at a desired bulk resonant frequency. By providing the acoustic impedance match, the inert piezoelectric layer helps to provide efficient acoustic coupling between the probe and the medium under examination by the probe.

The respective inert piezoelectric layer of each element includes shallow grooves disposed on the respective front face of each piezoelectric element and extending through the thickness of the inert piezoelectric layer. More specifically, the shallow groves are microgrooves, typically extending into the respective face of each element less than 1000 microns. In general, a depth dimension of the grooves is selected to be approximately a quarter of a wavelength of the acoustic signals. A groove volume fraction of the inert piezoelectric layer is selected to control acoustic impedance of the inert piezoelectric layer so as to provide the desired acoustic impedance match. In an illustrative medical imaging application, each groove has a respective volume selected so that the inert piezoelectric layer substantially provides the desired acoustic impedance match between the bulk acoustic impedance of the piezoelectric element and an acoustic impedance of a medium of a patient's body.

The respective pair of electrodes electrically coupled to the piezoelectric ceramic material of each element includes a respective rear electrode coupled to a respective rear face of each element, and a respective front electrode coupled to the respective front face of each element. The front electrode extends into and contacts the grooves, imposing electrical boundary requirements that support a desired electrical field distribution within the element. Design parameters such as the width and pitch dimensions of the grooves are adjusted as needed so that for electrical potential measurable between the respective electrode pairs of each array element, there is relatively little electrical potential difference along the thickness of the respective inert piezoelectric layer of each element. For example, the width and pitch dimensions of the grooves are selected so that there is a relatively small electrical potential difference along the thickness of the inert piezoelectric layer that is less than approximately %5 of the electrical potential measurable between the pair of electrodes. Because the electrical potential along the thickness of the inert piezoelectric layer is relatively small, the dielectric constant measurable between the electrodes of the element is relatively high and is substantially the same as that which is intrinsic to the ceramic material of the element.

As will be discussed in greater detail later herein, the relatively high dielectric constant is desired so that a high capacitive charging is sensed by the electrodes in response to reflected acoustic waves received by the piezoelectric elements of the probe of the present invention. The relatively high dielectric constant also provides for an improved electrical impedance match between the probe and components of an acoustic imaging system electrically coupled to the probe. Accordingly, the present invention is not burdened by difficulties associated with electrically sensing acoustic waves in previously known high polymer composites, which have a relatively low dielectric constant.

A manufacturing advantage associated with the present invention is that the grooves can be easily etched or cut into a wide ranges of piezoelectric materials. Furthermore, because the inert piezoelectric layer is integral with the piezoelectric element, the present invention provides acoustic impedance matching without being burdened by manufacturing and reliability problems that are associated with adhesively bonding layers of dissimilar layers to piezoelectric ceramics. High frequency performance of the ultrasonic probe constructed in accordance with the teachings of the present invention is not limited by adhesive bond lines present in some previously known ultrasonic probes.

Other aspects and advantages of the present invention will become apparent from the following detailed description, taken in conjunction with the accompanying drawings, illustrating by way of example the principles of the invention.

DETAILED DESCRIPTION OF PREFERRED EMBODIMENT

Figure 4A:
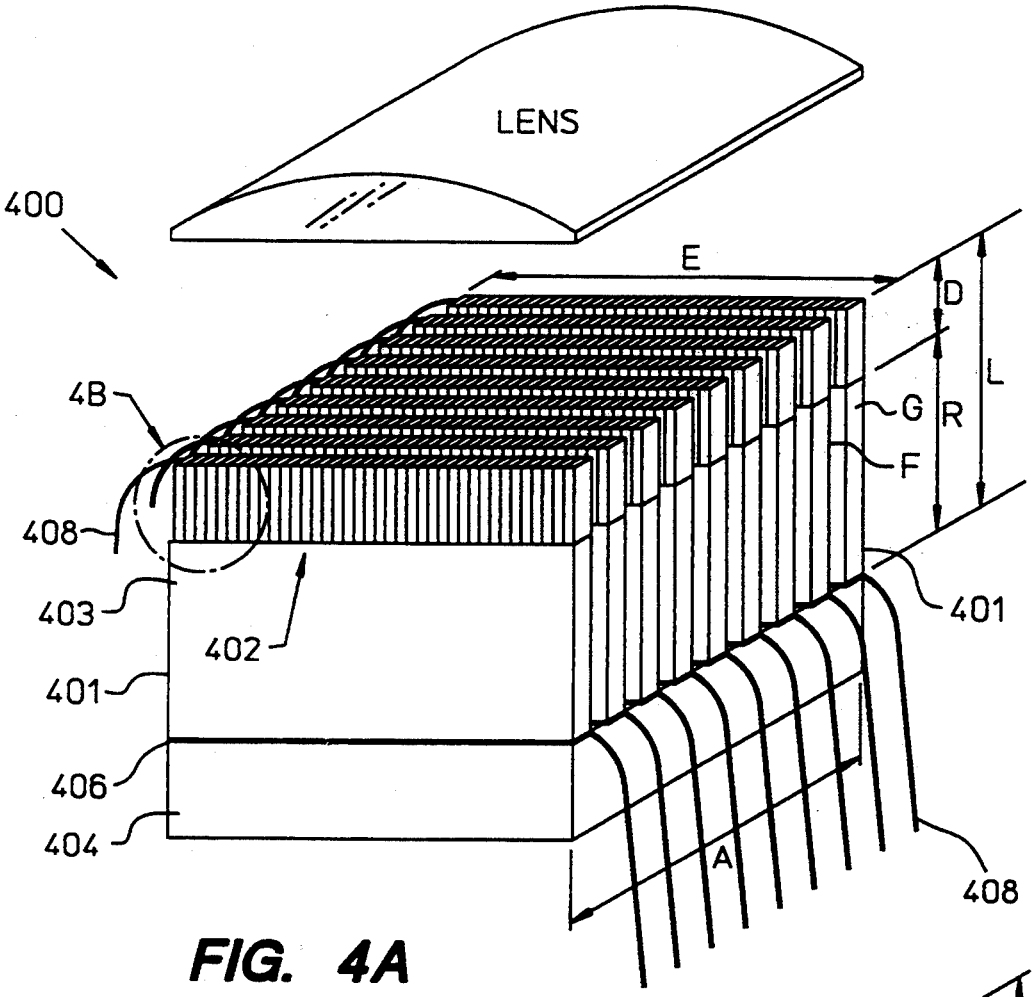
FIG. 4A shows an isometric view of an ultrasonic probe of a preferred embodiment of the present invention.

The ultrasonic probe of the present invention provides efficient and controlled coupling of an acoustic signal between the probe and the desired medium under examination, and further provides manufacturing, reliability and performance advantages. FIG. 4A is a simplified isometric view illustrating a preferred embodiment of the ultrasonic probe 400. As shown, the preferred embodiment of the ultrasonic probe includes an array of piezoelectric ceramic elements 401, each having a bulk acoustic impedance, $Z_{PZT}$, and each having a longitudinal dimension, L. Each element includes a respective piezoelectric ceramic layer 402 integral therewith and having a layer thickness defined by a depth dimension, D, of grooves extending through the layer. The respective piezoelectric layer of each element is substantially electromechanically inert. Each piezoelectric element further includes a respective bulk remainder portion 403, which is electromechanically active and resonates at a desired bulk resonant frequency along a bulk remainder dimension, R, shown in FIG. 4A. It is preferred that the bulk remainder dimension, R, be selected to be a half of a wavelength of the desired bulk resonant frequency.

Each array element has an elevational dimension, E, corresponding to an elevational aperture of the probe. Elevational aperture and the resonant acoustic frequency of each element are selected based on a desired imaging application. Typically, the elevational dimension, E, is selected to be between 7 and 15 wave lengths of the resonant acoustic frequency of the probe. As shown, the piezoelectric elements are arranged in a suitable spaced apart relation, F, along a azimuthal dimension, A, of the array and are supported by an epoxy or other appropriate backing material 404. As shown, each element has a suitably selected lateral dimension, G. Furthermore, a number of elements in the array is selected based on requirements of the imaging application. For example, an ultrasonic abdominal probe for a medical imaging application typically includes more than 100 elements and an elevational aperture of 10 wave lengths. For the sake of simplicity, far fewer elements are shown in the probe of FIG. 4A.

In the preferred embodiment, the piezoelectric elements are essentially embodied in specially contoured blocks of a piezoelectric ceramic material, such as lead zirconate titanate, PZT, each having a respective front face and rear face oriented approximately parallel to one another and being oriented approximately perpendicular to the respective longitudinal dimension, L, of each element. It should be understood that although PZT is preferred, other piezoelectric ceramic materials known to those skilled in the art may be alternatively employed in accordance with the principles of the present invention, with beneficial results.

The respective inert piezoelectric layer 402 integral with the respective front face of each piezoelectric element substantially provides an acoustic impedance match between the bulk acoustic impedance of each piezoelectric element and the acoustic impedance of a desired medium under examination. For example, in medical imaging applications, the respective inert piezoelectric layer provides an acoustic impedance match between the bulk acoustic impedance of each piezoelectric element and the acoustic impedance of a medium of a patient's body under examination. As shown in detailed view 4B, the respective inert piezoelectric layer 402 integral with each piezoelectric element 401 of the array includes the grooves 405, which are disposed on the respective front face of each element to control acoustic impedance of the layer. In the preferred embodiment, the grooves are arranged substantially parallel to one another along the respective elevational dimension, E, of each element.

Figure 4B:
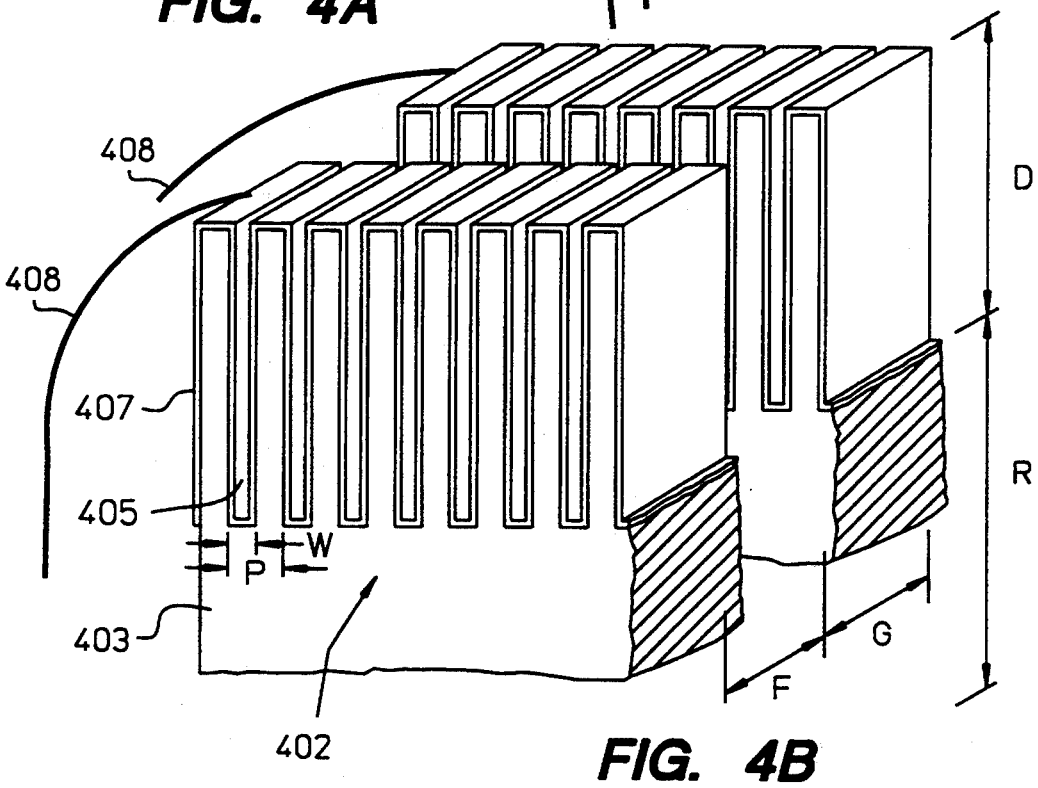
FIG. 4B shows a detailed cut away isometric view of the probe of FIG. 4A.

As shown in FIGS. 4A and 4B, a respective pair of metal electrodes is electrically coupled to the piezoelectric ceramic material each piezoelectric element. The respective pair of electrodes of each element includes a respective rear electrode 406 coupled to the respective rear face of each piezoelectric element and further includes a respective front electrode 407 extending into and contacting the grooves disposed on the respective front face of each piezoelectric element. This arrangement of electrodes helps to insure that the piezoelectric layer is substantially electromechanically inert. A conformal material, preferably air, is disposed within the grooves adjacent to each electrode. As will be discussed in greater detail later herein, a suitable alternative conformal material, for example polyethylene, may be used instead of air. The selected conformal material has an acoustic impedance, $Z_{conformal}$, associated therewith.

By applying a respective voltage signal to the respective pair of electrodes coupled to each piezoelectric element, the bulk remainder portion of each element is excited to produce acoustic signals having the desired resonant frequency. Respective conductors 408 are coupled to each electrode for applying the voltage signals. The acoustic signals are supported in propagation along the respective longitudinal dimension of each element by a longitudinal resonance mode of the piezoelectric element. The respective acoustic signals produced by each piezoelectric element of the array are emitted together from the respective inert piezoelectric layer as an acoustic beam that is transmitted into the medium of the body under examination. For example, in the medical imaging application, the acoustic beam is transmitted into the patient's body. Phasing of the respective voltage signals applied to each element of the array is controlled to effect azimuthal steering and longitudinal focussing of the acoustic beam as the acoustic beam sweeps though the body. An acoustic lens, shown in exploded view in FIG. 4A, is acoustically coupled to the elements to provide elevational focussing of the acoustic beam.

As the acoustic signals propagate through the patient's body, portions of the signal are weakly reflected by the various tissue structures within the body, are received by the piezoelectric elements, and are electrically sensed by the respective pair of electrodes coupled to each piezoelectric element. The reflected acoustic signals are first received by the respective inert piezoelectric layer integral with each piezoelectric element and then propagate along the respective longitudinal dimension of each piezoelectric element. Accordingly, the acoustic signals propagate through the inert piezoelectric layer with a first velocity, and then propagate through the bulk remainder portion of the piezoelectric element with a second velocity. It is preferred that the depth dimension, D, of the grooves of the inert with a second velocity. It is preferred that the depth dimension, D, of the grooves of the inert piezoelectric layer be selected to be a quarter of a wavelength of the acoustic signals traveling through the inert piezoelectric layer.

The depth dimension, D, of the grooves defines thickness of the respective inert piezoelectric layer integral with each of the piezoelectric elements. A depth dimension, W, of each groove and a pitch dimension, P, of the respective grooves are selected to separate lateral and shear resonance modes of the inert piezoelectric layer from undesired interaction with the longitudinal resonance mode of the piezoelectric element. Furthermore, the width and pitch of the grooves are selected to provide efficient transfer of acoustic energy through the inert piezoelectric layer. Additionally, the depth and pitch of the grooves are selected so that the inert piezoelectric layer appears homogenous to acoustic waves. In general, beneficial results are produced by a pitch to depth, P/D, of less than or equal to approximately 0.4, in accordance with additional grove teachings of the present invention discussed in greater detail later herein. The width and pitch dimensions of the grooves are further adjusted, if needed so that for an electrical potential measurable between the respective pair of electrodes of each array element, there is a relatively small electrical potential difference along the thickness of the inert piezoelectric layer. For example, the width and pitch dimensions of the grooves are selected so that there is an electrical potential difference along the thickness of the piezoelectric layer that is less than approximately %5 of the electrical potential measurable between the respective pair of electrodes of each element.

Acoustic impedance of the inert piezoelectric layer is controlled so as to provide an acoustic impedance match between the bulk acoustic impedance of each piezoelectric element and an acoustic impedance of the medium damping support body. Accordingly, the inert piezoelectric layer provides for efficient acoustic coupling between the piezoelectric element and the medium under examination. The acoustic impedance of the inert piezoelectric layer is substantially determined by groove volume fraction, which is based upon the width and pitch dimensions of the grooves 505 disposed on the respective front face of each of the piezoelectric elements 501.

A desired acoustic Impedance of the inert piezoelectric layer, $Z_{layer}$, is calculated to produce an impedance match between the bulk acoustic impedance of the ceramic material of the piezoelectric element, $Z_{PZT}$, and the acoustic impedance of the acoustically damping support body, $Z_{body}$, using an equation:

$$Z_{layer}=(Z_{PZT}\times Z_{body}^{1/2}$$

For example, given that the acoustic impedance of the acoustically damping support body, $Z_{body}$, is $3\times10^6$ kilograms/meter$^2$second, kg/m$^2$s, and that the bulk acoustic impedance of lead zirconate titanate, $Z_{PZT}$, is $33\times10^6$ kg/m$^2$s, the desired acoustic impedance of the inert piezoelectric layer, $Z_{layer}$, is calculated to be approximately $6.6\times10^6$ kg/m$^2$s.

The acoustic impedance of the inert piezoelectric layer is substantially controlled by the groove volume fraction of the inert piezoelectric layer. The groove volume fraction of the layer is defined by dividing a volume of a groove extending through the layer by a sum of the volume of the groove and a volume of remaining layer ceramic adjacent to the groove. A desired groove volume fraction, v, is calculated from the desired acoustic impedance of the layer and respective acoustic impedances of the piezoelectric ceramic material, and the conformal material. The desired volume fraction, v, is approximately equal to an expression:

$$(Z_{PZT}-Z_{layer})/(Z_{PZT}-Z_{conformal})$$

For example, given air as the conformal material having an acoustic impedance, $Z_{conformal}$, of 411 kg/m$^2$s, and given values for the acoustic impedance of the inert piezoelectric layer, $Z_{layer}$, and the bulk acoustic impedance of the ceramic material of the element, $Z_{PZT}$, as articulated previously herein, the desired groove volume fraction of the inert piezoelectric layer, v, is approximately 78.7%. A volume fraction of the ceramic of the layer complements the groove volume fraction. Accordingly, for this example, the ceramic volume fraction of the layer is approximately 21.3%.

A desired depth of the grooves, D, is calculated from a speed of sound in the inert piezoelectric layer, $C_{layer}$, and a quarter wavelength of the resonant acoustic frequency, f, of the piezoelectric element, using an equation:

$$D=\tfrac{1}{4}(C_{layer}/f)$$

Given that the desired groove volume fraction of the inert piezoelectric layer is approximately 78.7%, speed of sound in the inert piezoelectric layer, $C_{layer}$, can be estimated as being approximately $3.5\times10^5$ centimeters/second. Alternatively the speed of sound in the inert piezoelectric layer can be estimated using more sophisticated methods, such as those based on tensor analysis models of the inert piezoelectric layer. For instance, tensor analysis models discussed in "Modeling 1-3 Composite Piezoelectrics: Thickness-Mode Oscillations", by Smith et. al, pages 40–47 of IEEE Transactions on Ultrasonics, Ferroelectrics, and Frequency Control, Vol. 38, No 1, January, 1991, can be adapted to estimate speed of sound in the inert piezoelectric layer. Given that in the present example the speed of sound in the inert piezoelectric layer, $C_{layer}$ is estimated as $3.5\times10^5$ centimeters/second, the desired bulk resonant frequency, f, is 2 megahertz, MHz, the depth of the grooves, D, is approximately 437.5 microns. Accordingly, the grooves are shown to be micro-grooves, extending into the front face of the element less than 1000 microns.

A pitch, P, of the grooves is calculated so that the pitch is less than 0.4 of the depth of the grooves:

$$P\leqq(0.4\times D)$$

For example, given depth of the grooves, D, of approximately 437.5 microns, pitch of the grooves should be less than or equal to 175 microns.

Width of grooves, W, is calculated based upon the pitch, P, the groove volume fraction, v, and a correction factor, k, using an equation:

$$W=P\,v\times k$$

A desired value for the correction factor, k, is selected based on connectivity of the ceramic of the inert piezoelectric layer and the conformal material. For the inert piezoelectric layer having grooves arranged as shown in FIGS. 4A and 4B, the layer has 2–2 connectivity and the correction factor, k, is simply 1. In alternative embodiments, the grooves are alternately arranged so that the layer has a different connectivity, yielding a different correction factor. For instance, in an alternative embodiment, the grooves are arranged so that the layer has a 1–3 connectivity, yielding a different correction factor of 1.25. Given 2–2 connectivity so that the correction factor, k, is 1, given pitch of 175 microns, and given groove volume fraction of the inert piezoelectric layer of 78.7%, the width, W, of the grooves is approximately 137.7 microns.

For embodiments of the probe scaled to operate at a higher resonant frequency, relevant groove dimensions are scaled accordingly. For example, for an embodiment of the probe scaled to operate at a resonant acoustic frequency of 20 MHz, relevant groove dimensions of the 2 MHz probe example discussed previously are scaled by a factor of 10. Therefore, for an array of piezoelectric elements each having a bulk resonant frequency of 20 MHz and respective piezoelectric layers with grooves arranged for 2–2 connectivity, relevant dimensions of the grooves are scaled down by 10 so as to have pitch of 17.5 microns, width of 13.77 microns, and depth of approximately 43.75 microns. Accordingly, the grooves are once again shown to be micro-grooves, extending into the front face of the element less than 1000 microns.

A respective number of grooves along the elevational dimension, E, of each piezoelectric element of the array is related to the pitch of the grooves and the elevational aperture of the array. Typically, the respective number of grooves along the elevational dimension, E, is approximately between the range of 50 and 200 grooves to produce beneficial impedance matching results. As an example, for a given preferred elevational dimension, E, of 10 wave lengths of the acoustic signal, a preferred respective number of grooves along the elevational dimension is approximately 100 grooves. For the sake of simplicity, fewer grooves than 100 grooves are shown in FIG. 4A.

Front metal electrodes extend into and contact the grooves, imposing electrical boundary requirements that support a desired electrical field distribution within the element. Design parameters such as the width and pitch dimensions of the grooves are adjusted as needed to insure that for an electrical potential measurable between the respective electrode pairs of each array element, there is a relatively small potential difference along the thickness of the respective piezoelectric layer of each element. For example, the width and pitch dimensions of the grooves are selected so that there is a relatively small potential difference along the thickness of the inert piezoelectric layer that is less than approximately %5 of the electrical potential measurable between the respective pair of electrodes. It should be understood that for ultrasonic probes, there are a plurality of relevant sources of the electrical potential difference measurable between the respective pair of electrodes. For example, one relevant source of the electrical potential difference measurable between the respective pair of electrodes is voltage applied to the electrodes to excite acoustic signals in each piezoelectric ceramic element. Another relevant source of the electrical potential difference measurable between the respective pair of electrodes is voltage induced in each piezoelectric element by weakly reflected acoustic signals received by each element.

Figure 5:
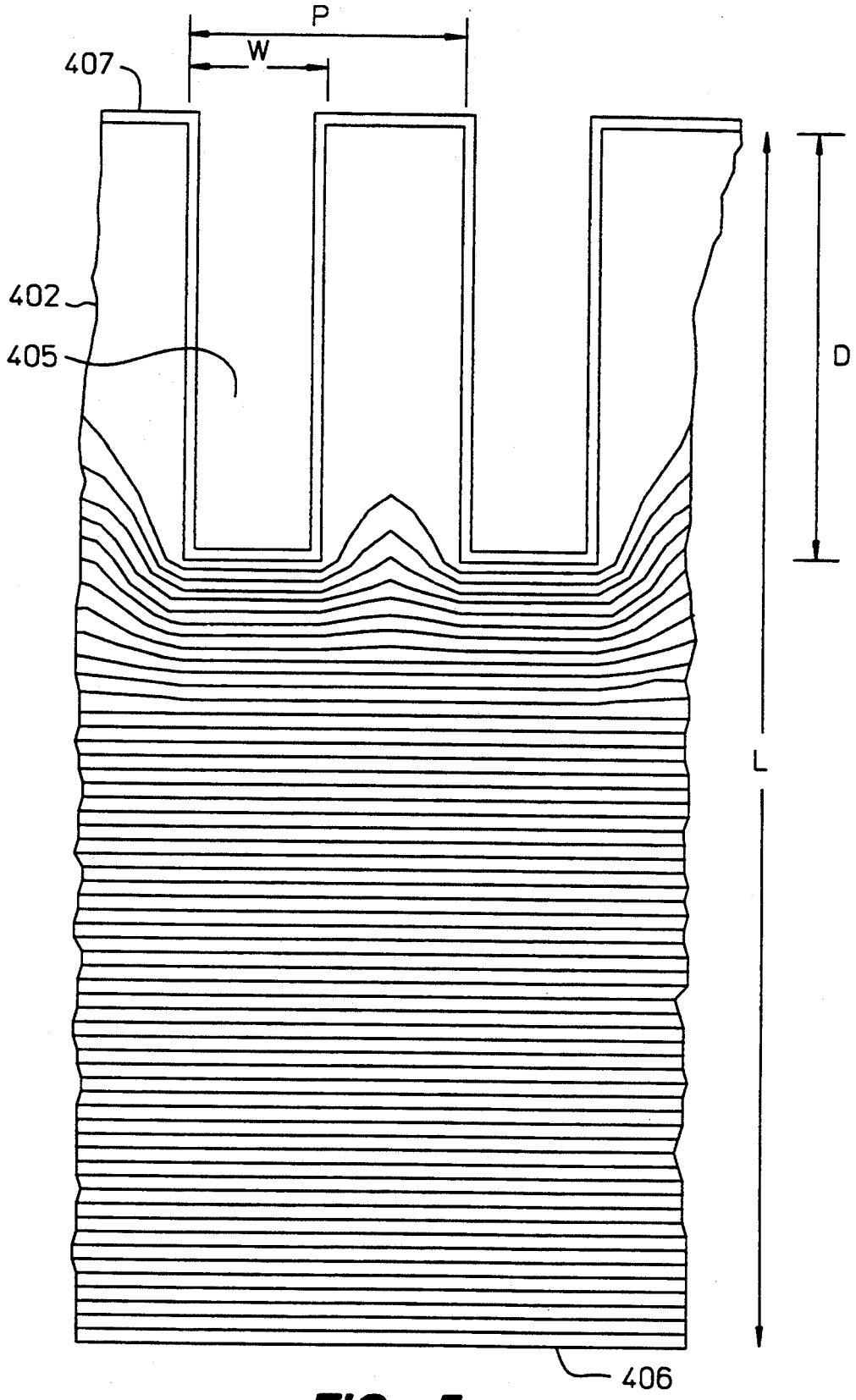
FIG. 5 is a diagram illustrating lines of electric equipotential distributed along a longitudinal dimension of a piezoelectric element of the probe of FIG. 4A.

The relatively small electrical potential difference along the thickness of the piezoelectric layer is graphically illustrated in FIG. 5. FIG. 5 is a detailed cut away sectional view of one of the piezoelectric elements of FIG. 4A, providing an illustrative diagram showing lines of electrical equipotential distributed along the longitudinal dimension, L, of the element for the example of width and depth of grooves discussed previously herein. Although lines of electrical equipotential are invisible, representative lines are drawn into the diagram of FIG. 5 for illustrative purposes. As shown in cross section, grooves having pitch, P, width, W, and depth, D, extend into the front face of the element, through the thickness of the piezoelectric layer 402. Given an exemplary 1 volt potential measurable between the pair of electrodes 406, 407, the lines of equipotential shown in FIG. 5 correspond to 0.01 Volt increments in potential. Since electrical boundary requirements provide that there is substantially no tangential component of any electric field at a conductor boundary, and since electric fields distributions change gradually, the front metal electrodes extend into and contact the grooves to impose electrical boundary requirements that support the desired electrical field distribution within the element. As shown in FIG. 5, there is a relatively small electrical potential difference along the thickness of the inert piezoelectric layer, D, that is only approximately %3 of the electrical potential applied to the pair of electrodes of the array element. Because the electrical potential difference along the thickness of the inert piezoelectric layer is relatively small as shown in FIG. 5, the dielectric constant measurable between the electrodes 406, 407 of the element is substantially the same as that which is intrinsic to the lead zirconate titanate material of the element, and therefore is relatively high. Furthermore, the relatively small potential difference along the thickness of the piezoelectric layer further helps to insure that the piezoelectric layer is substantially electromechanically inert.

Upon the element receiving weakly reflected acoustic signals as discussed previously herein, capacitive charging of the electrodes is driven by a displacement current. The displacement current is linearly proportional to a product of an electric potential measurable between the respective pair of electrodes and the dielectric constant. Accordingly, the relatively high dielectric constant provides a relatively high capacitive charging. The high capacitive charging Is desired to efficiently drive cabling that electrically couples the electrodes to acoustic imaging system components, which analyze a relative temporal delay and intensity of the weakly reflected acoustic signal received by the probe and electrically sensed by the electrodes. From the analysis, the imaging system extrapolates a spaced relation of the various structures within the body and qualities related to the acoustic impedance of the structures to produce an image of structures within the body.

Similarly, electrical impedance of each element is inversely proportional to the dielectric constant of each element. The relatively high dielectric constant provides a relatively low electrical impedance. The low electrical impedance of each element is desired to provide an improved impedance match to a low electrical impedance of the cabling and to a low electrical impedance of imaging system components.

Figure 6A:
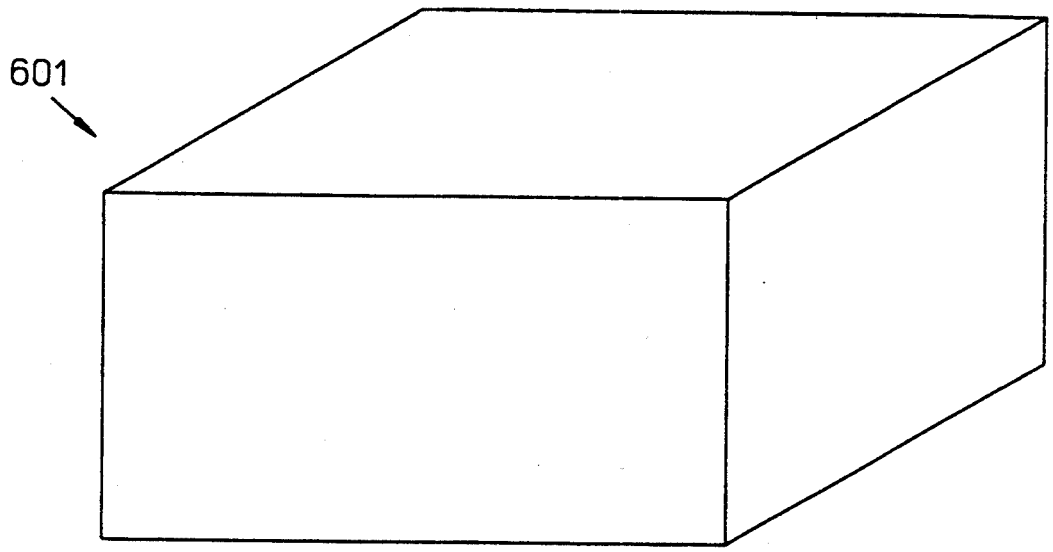
FIGS. 6A–D are simplified isometric views illustrating steps in making the probe of FIG. 4A.
Figure 6B:
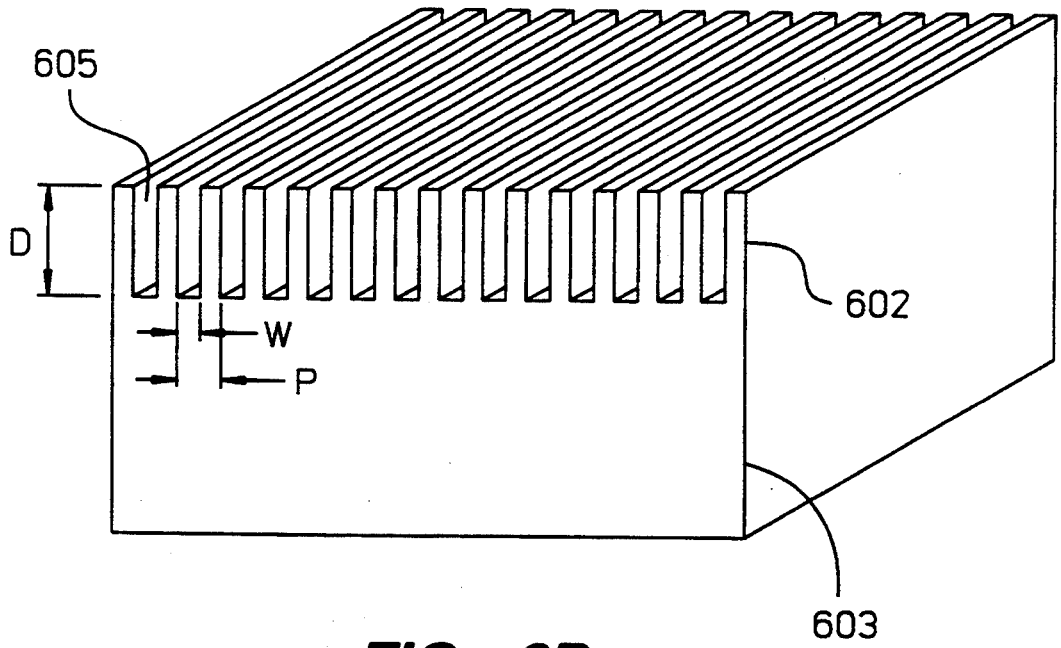

Fabrication, poling, and dicing of the piezoelectric elements of the array are illustrated and discussed with reference to simplified FIGS. 6A–D. An initial step is providing a slab of raw piezoelectric ceramic material as shown in FIG. 6A. Since the raw material has not yet been poled, there is only random alignment of individual ferroelectric domains within the material and therefore the material is electromechanically inert. As shown in FIG. 6B, the slab includes an inert piezoelectric layer 602 integral with the slab and a bulk remainder portion 603 of the slab. The inert piezoelectric layer is characterized by grooves 605 having a depth, D, cut into a front face of the slab and extending through a thickness of the layer. The grooves are cut into the slab using a blade of a dicing machine. Width of the blade is selected so that the grooves have the desired width dimension, W. Controls of the dicing machine are set to cut the grooves at the desired pitch, P, and depth, D. Alternatively, photolithographic processes utilizing chemical etching may be employed to etch the grooves into the front surface of the slab at the desired pitch, depth, and width. As another alternative, the grooves can be ablated onto the front face of the slab using a suitable laser.

Figure 6C:
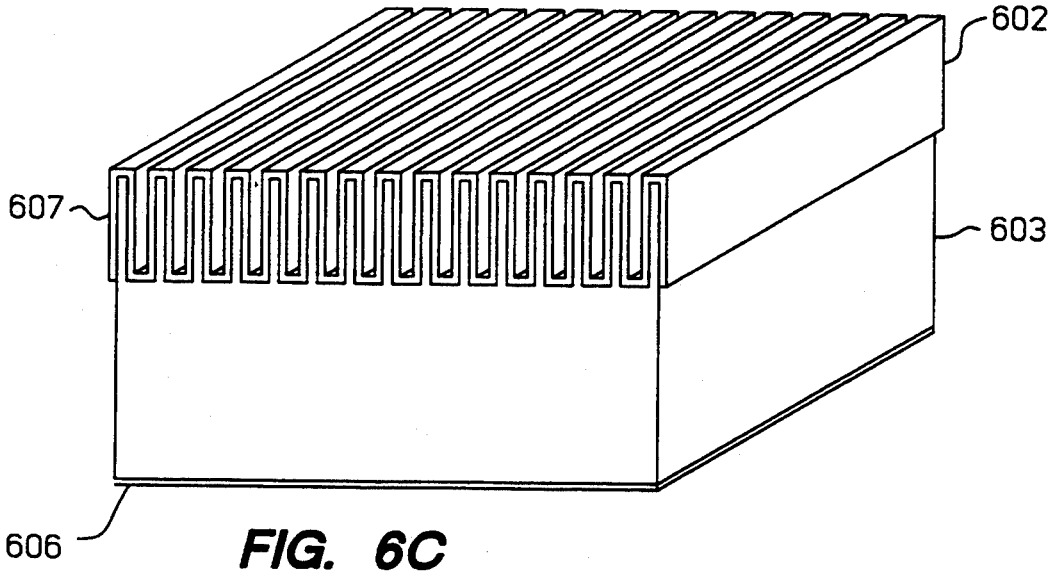

Metal electrodes are deposited onto the slab by sputtering. A thin metal film having a selected thickness between approximately 1000 to 3000 angstroms is sputtered onto the rear face to produce a rear electrode 606, and another similar thin metal film is sputtered onto the front face to produce a front electrode 607, as shown in FIG. 6C. The metal film of the front electrode 607 extends into and contacts the grooves in the front face of the slab.

A poling process comprises placing the slab into a suitable oven, elevating a temperature of the slab close to a curie point of the raw piezoelectric ceramic material, and then applying a very strong direct current, DC, electric field of approximately 20 kilovolts/centimeter across the front and rear electrodes while slowly decreasing the temperature of the slab. Because an electrical potential difference along the thickness of the inert piezoelectric layer including the grooves is only a small fraction of a total electrical potential between the electrodes, the inert piezoelectric layer 602 substantially retains the random alignment of individual ferroelectric domains present in the raw piezoelectric material. Accordingly, the inert piezoelectric layer 602 is only very weakly poled and remains electromechanically inert. The weak poling of the piezoelectric layer further helps to insure that the layer is electromechanically inert. In contrast, the poling process aligns a great majority of individual ferroelectric domains in the bulk remainder portion 603 of the piezoelectric slab. Accordingly, the bulk remainder portion 603 of the slab is very strongly poled and is electromechanically active.

Figure 6D:
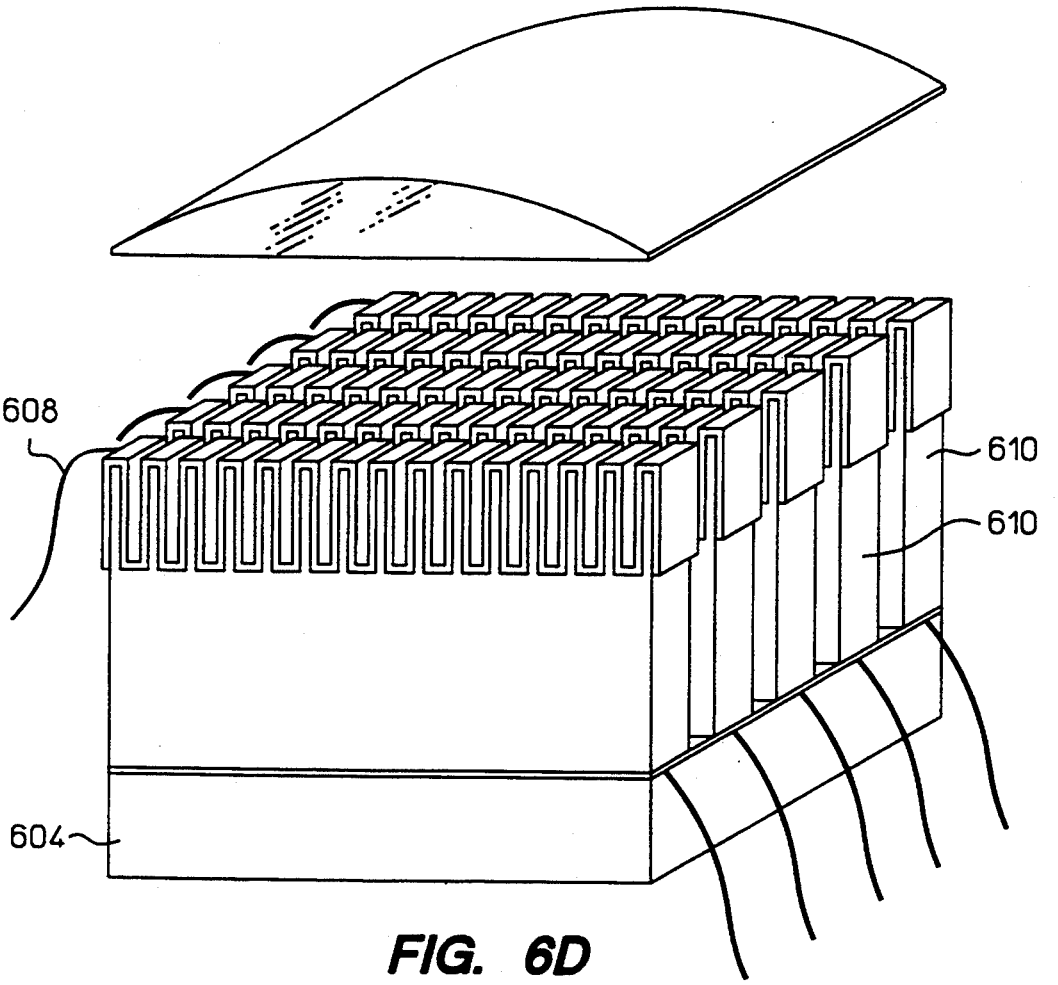

Conformal material is disposed in the grooves. As discussed previously herein, in the preferred embodiment the conformal material is a gas, such as air. In another preferred embodiment, the conformal material is a low density conformal solid, such as polyethylene. Conducting leads 608 are electrically coupled to the metal films, as shown in FIG. 6D, using a wire bonding technique. Alternatively, the conducting leads may be electrically coupled to the metal films by a very thin layer of epoxy or by soldering. An epoxy backing material 604 is cast on the rear face of the slab to support the slab, as shown in FIG. 6D. The dicing machine cuts entirely through the piezoelectric slab at regularly spaced locations to separate distinct piezoelectric elements of the array 610. An acoustic lens shown in exploded view in FIG. 6D is cast from a suitable resin on the front face of the piezoelectric elements.

The inert piezoelectric layer that provides acoustic impedance matching in accordance with the principles of the present invention also provides enhanced operational performance at high acoustic frequencies because the layer is integral with the piezoelectric element. In previously known ultrasonic transducers, a dissimilar impedance matching layer was made separate from the piezoelectric element and then bonded to the transducers using a typical 2 micron layer of adhesive cement, resulting in performance limitations as discussed previously herein. One measure of the enhanced operational performance of the present invention is reduced ring down time in impulse response of the piezoelectric elements of the probe. Such impulse response can be simulated using a digital computer and the KLM model as discussed previously herein.

Figure 1:
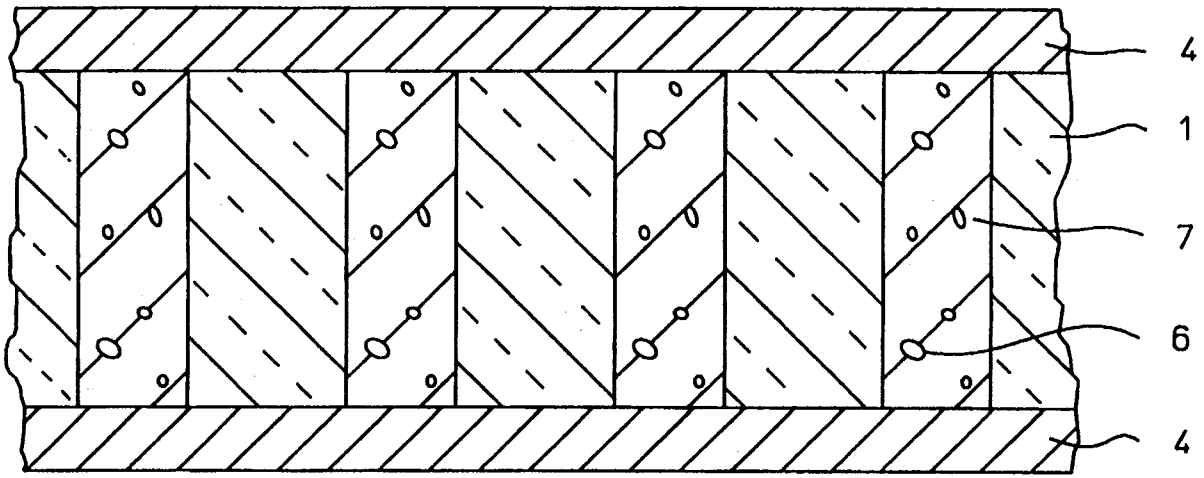
FIG. 1 (PRIOR ART)
FIG. 1 shows a cut away cross sectional view of a previously known ultrasonic transducer.
Figure 2:
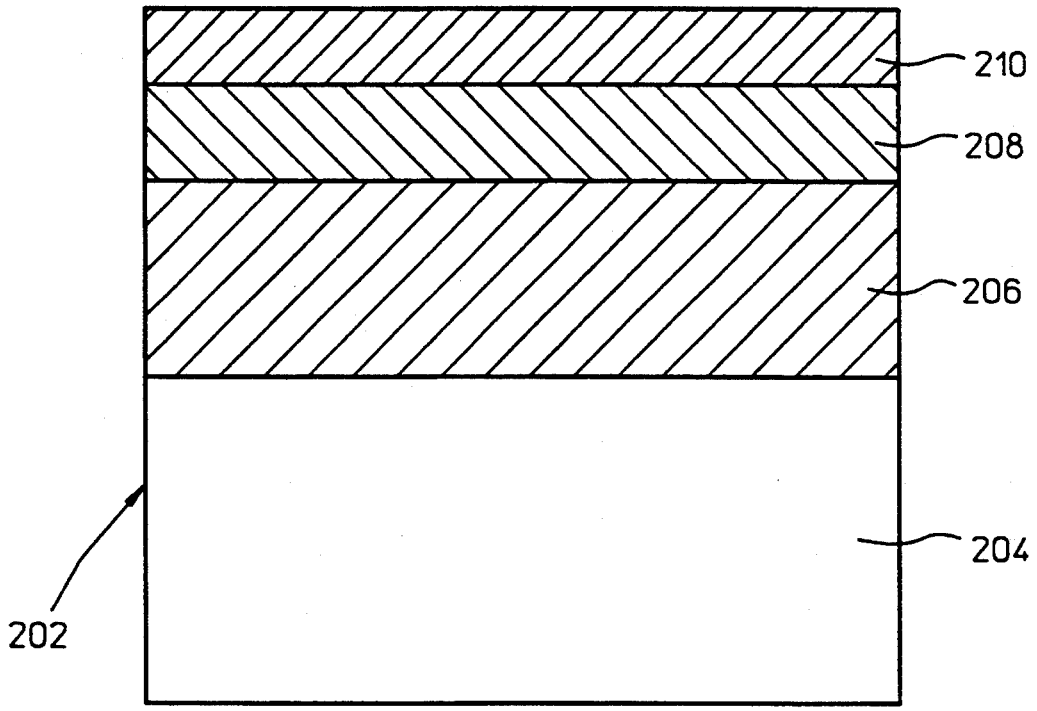
(PRIOR ART) FIG. 2
FIG. 2 shows a cross sectional view of another previously known ultrasonic transducer.
Figure 3:
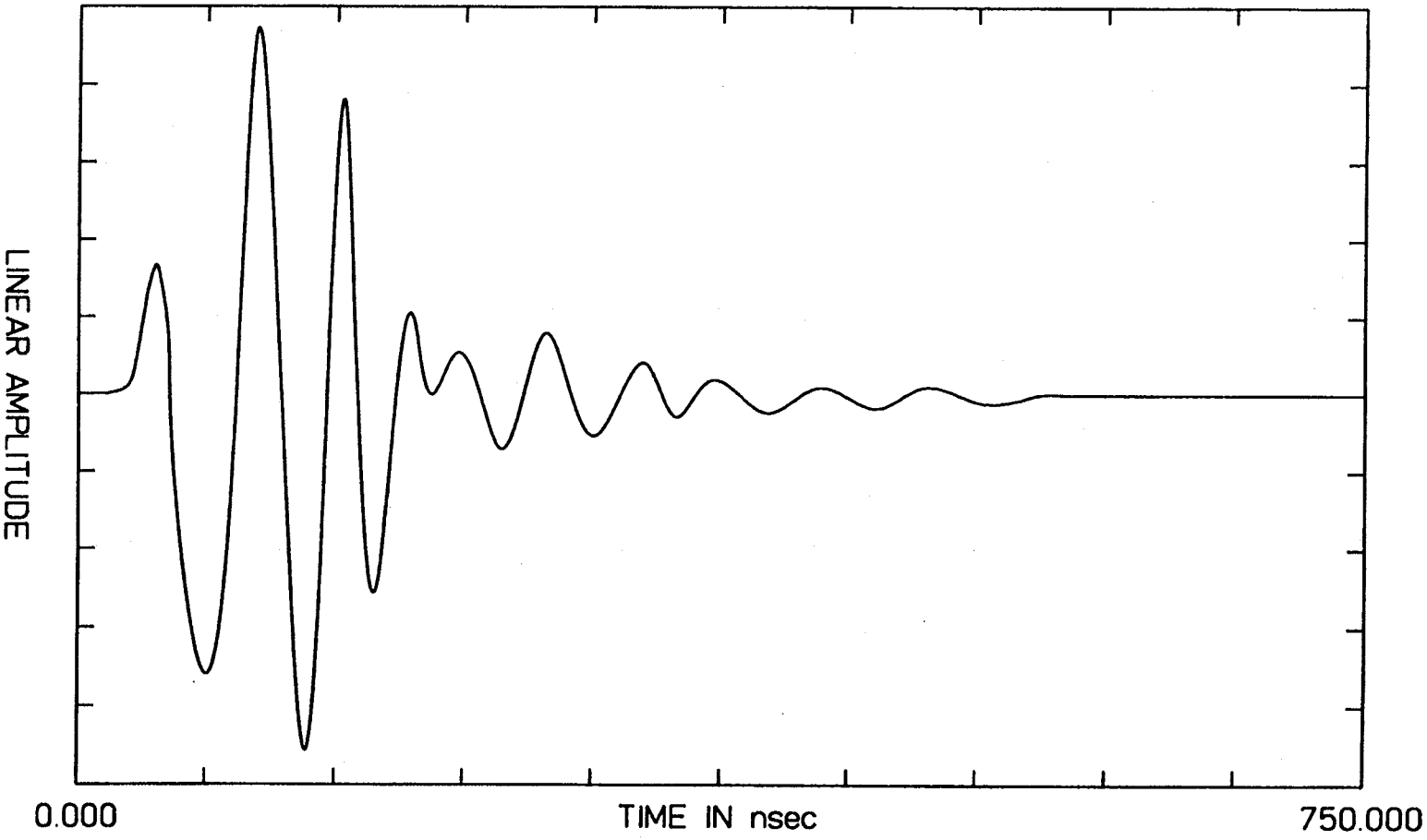
FIG. 3 is a diagram illustrating a simulated impulse response of the transducer of FIG. 2.
Figure 7:
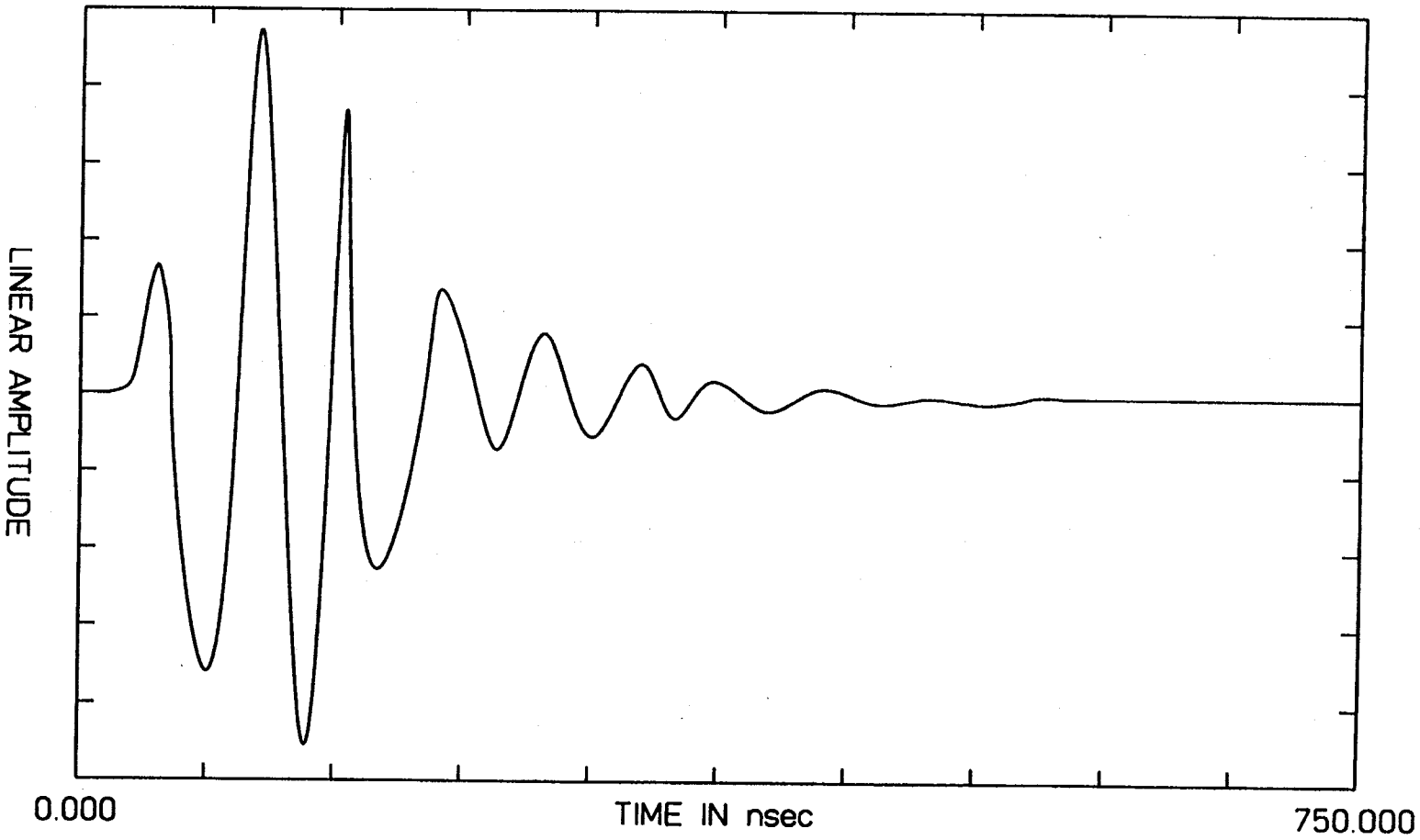
FIG. 7 is a diagram illustrating a simulated impulse response of a probe similar to that shown in FIG. 4A.

FIG. 7 is a diagram of a simulated impulse response of the piezoelectric element similar to that shown in FIG. 4A but having a resonant frequency of 20 Megahertz, and radiating into water. In accordance with the impulse response diagram shown in FIG. 7, simulation predicts a reduced −6 decibel (db) ring down time of 86.331 nanoseconds (nsec), a reduced −20 db ring down time of 256.566 nsec, and a reduced −40 db ring down time of 431.355 nsec. In contrast, the impulse response of the previously known transducer shown in FIG. 3 and discussed previously herein shows the protracted ring down time, By selecting arrangement and dimensions of the grooves disposed on the surface of the piezoelectric element, desired acoustic properties of the inert piezoelectric layer are tailored to satisfy various acoustic frequency response requirements. In some alternative embodiments, the grooves include a plurality of sets of grooves in each piezoelectric element, for providing the piezoelectric elements with enhanced acoustic impulse frequency response. Each set of grooves includes members having a respective groove depth related to a respective wavelength of the acoustic signals. Such alternative embodiments are made in a similar manner as discussed previously with respect to FIGS. 6A–D.

Figure 8:
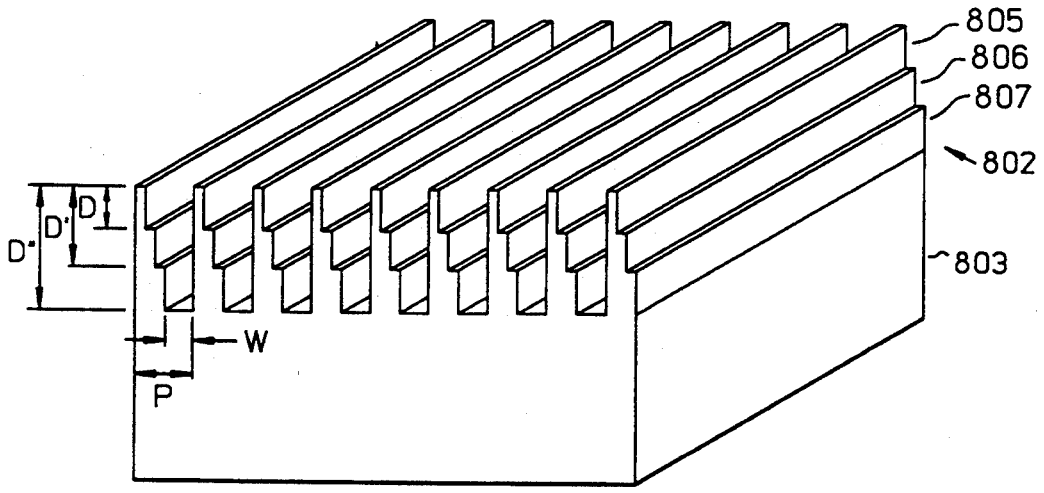
FIG. 8 illustrates an alternative embodiment of grooves extending through the piezoelectric layer of the present invention.

For example, a first alternative embodiment of the inert piezoelectric layer of the present invention is illustrated in FIG. 8. As in FIG. 6B discussed previously, FIG. 8 shows a slab of piezoelectric material having an inert piezoelectric layer 802 integral with the slab, grooves extending through the layer, and a bulk remainder portion 803 of the slab. In contrast to FIG. 5B discussed previously, the grooves of FIG. 8 include a first set of grooves 805, a second set of grooves 806, and third set of grooves 807 arranged adjacent one another. As shown, the grooves are cut into the slab so that the grooves have a pitch, P, and a width, W. Each member of the first set of grooves is cut into the front face of the piezoelectric element at a respective depth, D, which is approximately equal to an integral multiple of one quarter of a first wavelength of the acoustic signals. Similarly, each member of the second set of grooves has a respective depth dimension, D′, which is approximately equal to an integral multiple of one quarter of a second wavelength of the acoustic signals. Each member of a third set of grooves has a respective depth dimension, D″, which is approximately equal to an integral multiple of one quarter of a third wavelength of the acoustic signals. Respective members of the first, second and third set of grooves are arranged in a "stair step" pattern as shown in FIG. 8. A single conformal material can be deposited in each set of grooves. Alternatively, a different conformal material can be deposited in each set of grooves to achieve the desired frequency response. Sputtering, poling and dicing processes are then performed in a similar manner as discussed previously with respect to FIGS. 6C and 6D in order to complete alternative embodiment of the ultrasonic probe having enhanced frequency response.

Figure 9:
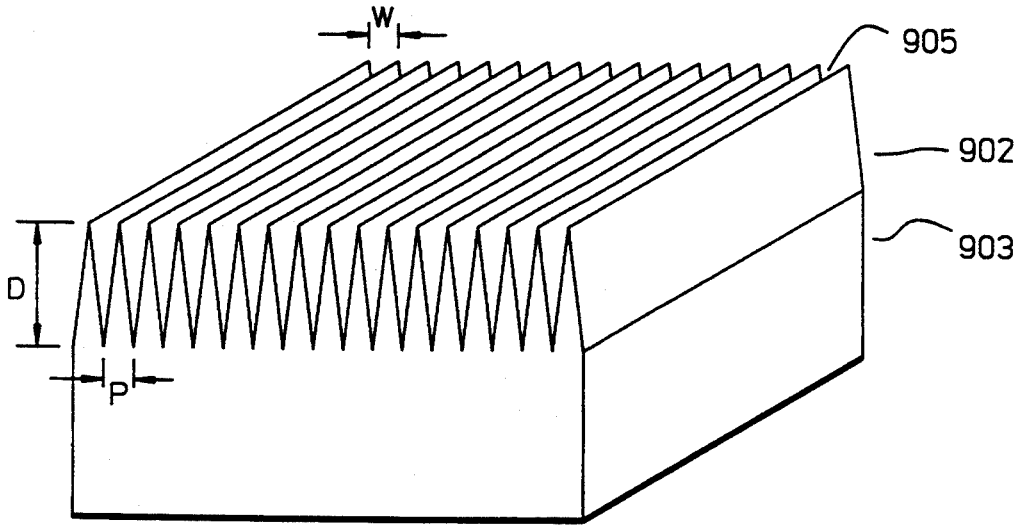
FIG. 9 illustrates another alternative embodiment of grooves extending through the piezoelectric layer of the present invention.

In other alternative embodiments, a smoothed groove profile is etched, in place of the abrupt "stair step" pattern, to provide the piezoelectric elements with enhanced acoustic performance such as broad frequency response or improved acoustic sensitivity. For example, such alternative embodiments include grooves each having a smoothed "V" profile and extending into the front surface of the piezoelectric element. Such alternative embodiments are made in a similar manner as discussed previously with respect to FIGS. 6A–D. For example, another alternative embodiment of the inert piezoelectric layer of the present invention is illustrated in FIG. 9. As in FIG. 6B discussed previously, FIG. 9 shows a slab of piezoelectric material having an inert piezoelectric layer 902 integral with the slab, grooves extending through the layer, and a bulk remainder portion 903 of the slab. In contrast to FIG. 6B discussed previously, the grooves of FIG. 9 include grooves 905 having the smoothed "V" profile. As shown, the grooves are etched into the slab so that the grooves have pitch, P, and width, W, and depth, D.

Figure 10:
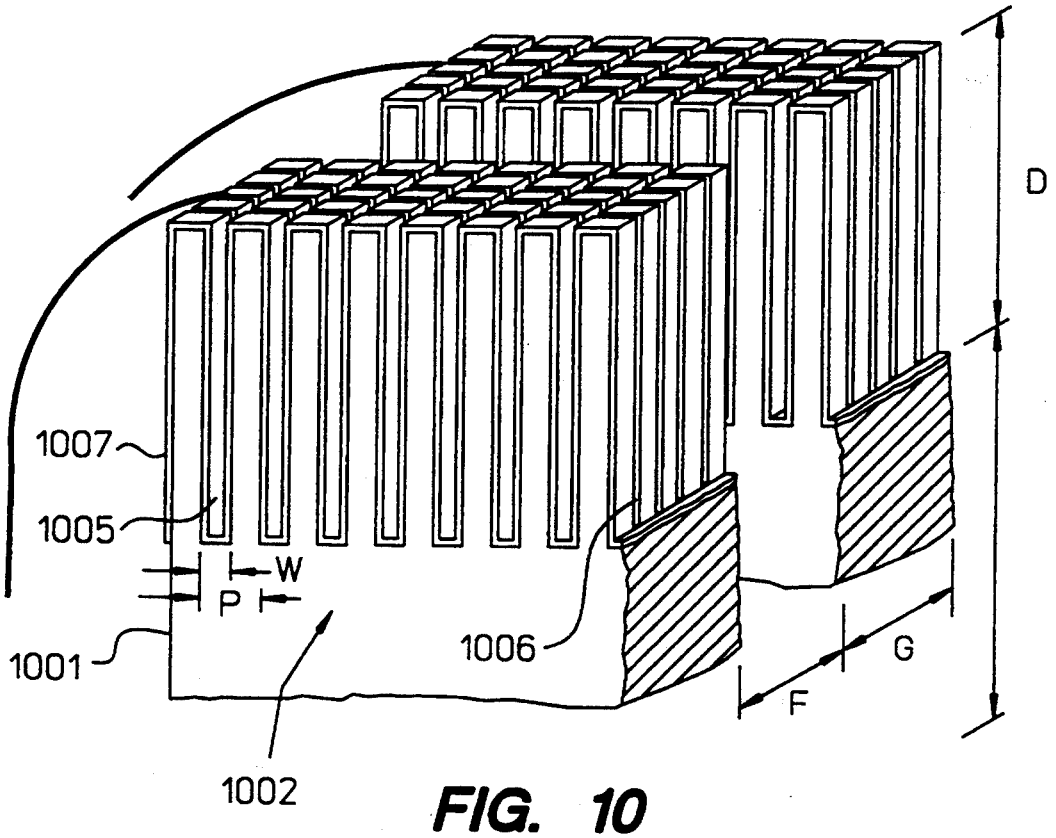
FIG. 10 is a detailed isometric view of yet another alternative embodiment of the invention.

Still other embodiments provide alternative arrangements of grooves on the respective front surface of each piezoelectric element. For example, in contrast to the preferred embodiment shown in detail in FIG. 4B wherein the grooves disposed on each piezoelectric element are arranged substantially parallel to one another, yet another preferred embodiment is shown in detail in FIG. 10 wherein each piezoelectric element 1001 includes a respective inert piezoelectric layer 1002 having a first and second set of grooves, 1005, 1006 arranged substantially perpendicular to one another on the respective front surface of each element. A metal film is sputtered onto the front face of each element to provide a respective front electrode 1007 extending into and contacting the grooves. Accordingly, the metal film blankets the grooves. Air is used as a conformal material disposed in the grooves. Because of the arrangement of the grooves shown in FIG. 10, the layer has 3–1 connectivity. As discussed previously, the grooves are cut into the piezoelectric elements using a dicing machine so as to have depth, D, width, W, and pitch, P. Alternatively, the grooves are selectively etched into elements using photolithography and chemical etchants, or are ablated using a laser.

Figure 11:
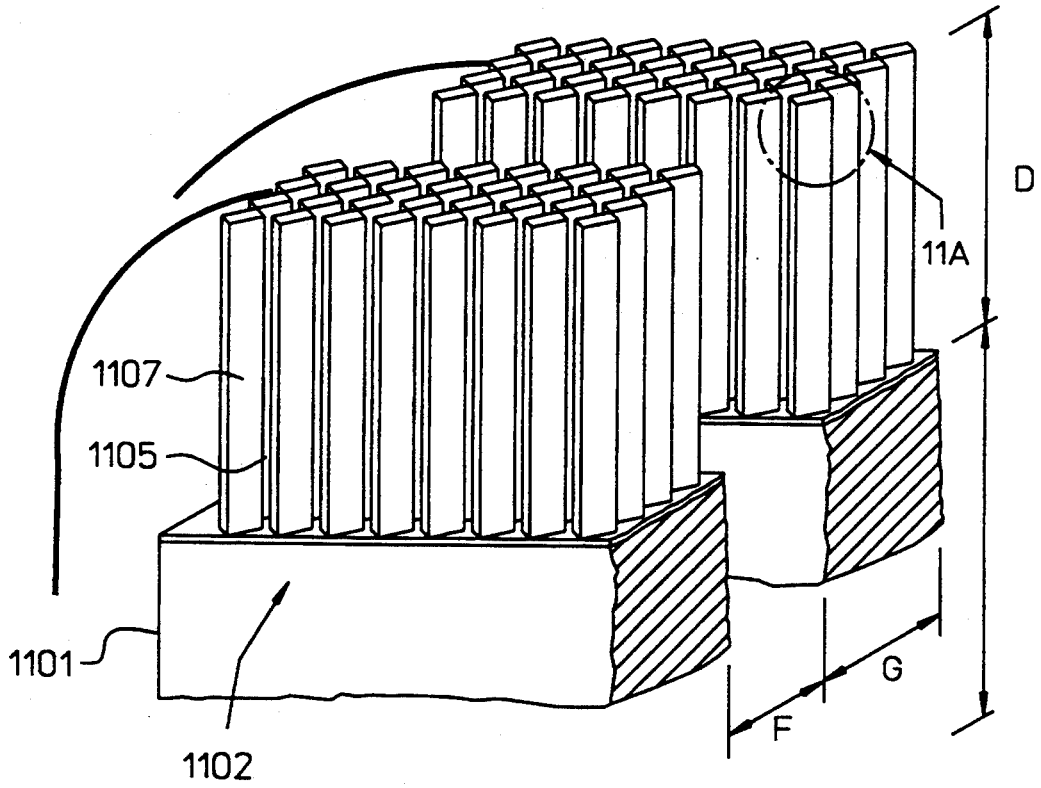
FIG. 11 is a detailed isometric view of yet another alternative embodiment of the invention.
Figure 11A:
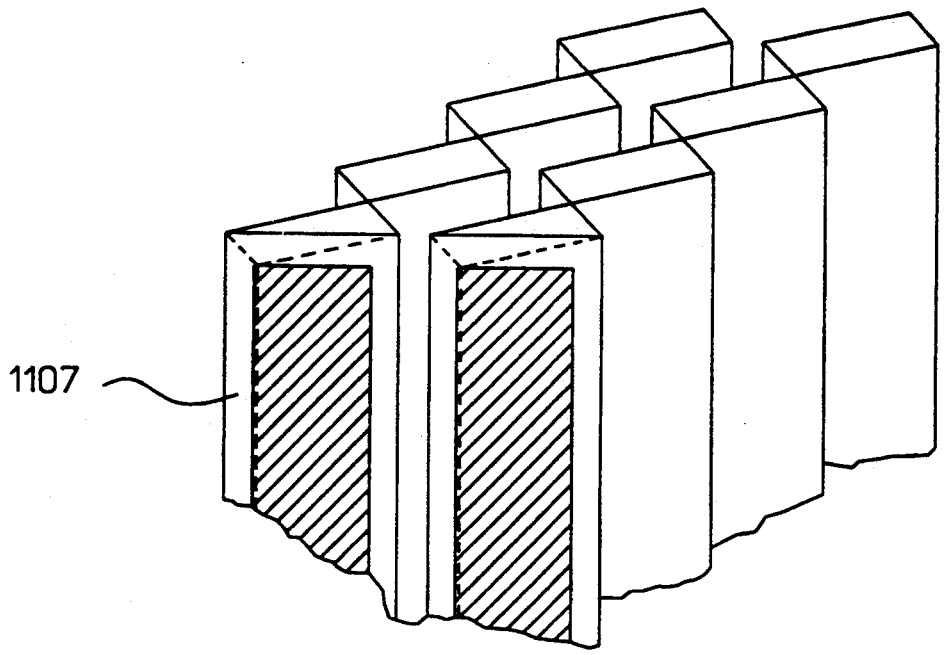
FIG. 11A is a further detailed cut away isometric view of a piezoelectric layer shown in FIG. 11.

Another alternative arrangement of grooves on the respective front surface of each piezoelectric element is shown in detail in FIG. 11 wherein each piezoelectric element 1101 includes a respective inert piezoelectric layer 1002 having specially contoured grooves 1105 etched into the layer. The specially contoured grooves provide lozenge shaped remainder ceramic portions of the piezoelectric layer. A respective front electrode 1107 extending into and contacting the grooves is deposited as a metal film by sputtering. The metal film blankets the groves of the layer. In a further detailed cut away view 11A the metal film of the electrode is cut away to show the weakly poled piezoelectric ceramic material of the inert piezoelectric layer. Air, used as conformal material disposed in the grooves. Because of the specially contoured grooves shown in FIG. 11, the piezoelectric layer has 1–1 connectivity.

Figure 12:
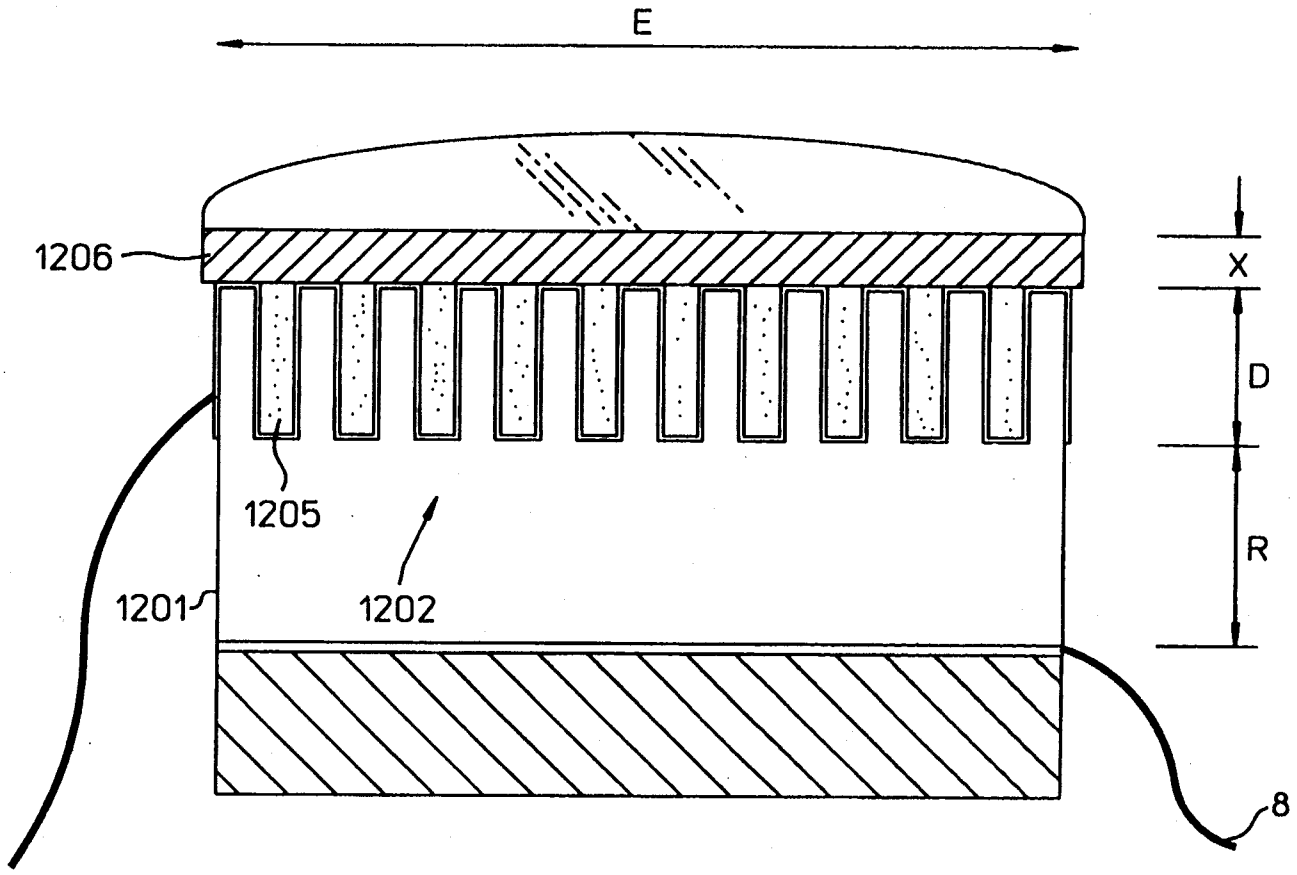
FIG. 12 is a detailed cross sectional view of yet another alternative embodiment of the invention.

A greatly simplified cross section view of yet another alternative embodiment of the present invention is shown in FIG. 12, similar to that discussed previously herein with respect to FIG. 4A. As shown, a piezoelectric element 1201, having an elevational dimension, E, includes an integral inert piezoelectric layer 1202 having grooves 1205 extending a depth, D, into a front face of the element. However, the alternative embodiment shown in FIG. 12 includes polyethylene as a conformal material disposed in the grooves, instead of air as discussed previously herein with respect to FIG. 4A. Additionally, the alternative embodiment includes a second impedance matching layer 1206 bonded to the inert piezoelectric layer, the second layer having thickness, X, and an acoustic impedance selected to further improve an impedance match between the bulk acoustic impedance of the piezoelectric element 1201 and the acoustic impedance of the desired media under examination by the probe.

Although specific embodiments of the invention have been described and illustrated, the invention is not to be limited to the specific forms or arrangements of parts so described and illustrated, and various modifications and changes can be made without departing from the scope and spirit of the invention. Within the scope of the appended claims, therefore, the invention may be practiced otherwise than as specifically described and illustrated.

What is claimed is:

1. An ultrasonic probe for coupling acoustic signals between the probe and a medium having an acoustic impedance, the probe comprising:

an array of piezoelectric elements each having a bulk acoustic impedance, a respective front face for acoustically coupling each element to the medium, and a respective opposing rear face, a respective piezoelectric layer integral with each piezoelectric element for substantially providing an acoustic impedance match between the bulk acoustic impedance of each piezoelectric element and the acoustic impedance of the medium, the respective piezoelectric layer including grooves disposed on the respective front face of each piezoelectric element; and a respective pair of electrodes, electrically coupled to each piezoelectric element, the respective pair of electrodes including a respective rear electrode coupled to the respective rear face of each piezoelectric element and a respective front electrode extending into and contacting the grooves disposed on the respective front face of each piezoelectric element.

2. A probe as in claim 1 wherein each element has a respective number of grooves disposed on each element within a range of approximately 50 to 200 grooves.

3. A probe as in claim 2 wherein the respective number of grooves disposed on each element is approximately 100 grooves.

4. An ultrasonic probe for coupling acoustic signals between the probe and a medium having an acoustic impedance, the probe comprising:

a piezoelectric element having a bulk acoustic impedance, a front face for acoustically coupling the element to the medium, and an opposing rear face;

a piezoelectric layer integral with the piezoelectric element for substantially providing an acoustic impedance match between the bulk acoustic impedance of the piezoelectric element and the acoustic impedance of the medium, the piezoelectric layer including grooves disposed on the front face of the piezoelectric element; and a pair of electrodes, electrically coupled to the piezoelectric element, the pair of electrodes including a rear electrode coupled to the rear face of the piezoelectric element and a front electrode extending into and contacting the grooves disposed on the front face of the piezoelectric element.

5. An ultrasonic probe as in claim 4 wherein each of the grooves has a respective volume selected for substantially matching the acoustic impedance of the medium with the bulk acoustic impedance of the piezoelectric element.

6. An ultrasonic probe as in claim 4 wherein the grooves each have a respective depth dimension extending into the front face, the respective depth dimension being approximately equal to one quarter of a wavelength of the acoustic signals.

7. An ultrasonic probe as in claim 4 further comprising a conformal material disposed within the grooves.

8. An ultrasonic probe as in claim 7 wherein:

the piezoelectric layer has surface features that are adjacent to the grooves; and the grooves are arranged on the front surface so that the conformal material is two dimensionally connected to itself and so that each of the surface features is two dimensionally connected to itself.

9. An ultrasonic probe as in claim 7 wherein:

the piezoelectric layer has surface features that are adjacent to the grooves; and the grooves are arranged on the front surface so that the conformal material is three dimensionally connected to itself and so that each of the surface features is one dimensionally connected to itself.

10. An ultrasonic probe as in claim 7 wherein:

the piezoelectric layer has surface features that are adjacent to the grooves; and the grooves are arranged on the front surface so that the conformal material is one dimensionally connected to itself and so that each of the surface features is one dimensionally connected to itself.

11. An ultrasonic probe as in claim 4 wherein a dielectric constant measurable between the pair of electrodes is substantially the same as that which is intrinsic to a piezoelectric material of the element.

12. An ultrasonic probe for coupling acoustic signals between the probe and a medium having an acoustic impedance, the probe comprising:

a body of a piezoelectric ceramic material having a piezoelectric ceramic layer portion contiguous with a bulk remainder portion of the piezoelectric ceramic material, the layer and the remainder each having a respective acoustic impedance; and a means integral with the body for controlling the acoustic impedance of the piezoelectric ceramic layer so as to substantially match the acoustic impedance of the remainder with the acoustic impedance of the medium.

13. An ultrasonic probe as in claim 12 wherein the piezoelectric ceramic layer is weakly poled relative to the bulk remainder of the piezoelectric ceramic material.

14. An ultrasonic probe as in claim 12 wherein the means for controlling the acoustic impedance of the layer comprises grooves having dimensions selected for controlling the acoustic impedance of the layer, the grooves being disposed on a surface of the body and being sufficiently shallow so as to extend only through the layer portion of the body.

15. An ultrasonic probe as in claim 14 wherein the grooves each have a respective depth dimension extending into the piezoelectric ceramic layer, the respective depth dimension being approximately equal to a quarter of a wavelength of the acoustic signals.

16. An ultrasonic probe as in claim 14 wherein the grooves include a first and second set of grooves, each member of the first set of grooves having a respective depth dimension that is approximately equal to a quarter of a first wavelength of the acoustic signals, each member of the second set of grooves having a respective depth dimension that is approximately equal to a quarter of a second wavelength of the acoustic signals.

17. An ultrasonic probe as in claim 16 wherein a first conformal material is disposed in the first set of microgrooves and a second conformal material is disposed in the second set of microgrooves.

18. An ultrasonic probe as in claim 12 wherein:

the piezoelectric ceramic body has a front face and a rear face, the piezoelectric ceramic layer being integral with the front face;

the probe further comprises a pair of electrodes electrically coupled to the piezoelectric ceramic body, the pair of electrodes including a rear electrode electrically coupled to the rear face of the piezoelectric ceramic body and a front electrode electrically coupled to the front face of the piezoelectric ceramic body; and an electrical potential along a thickness of the piezoelectric ceramic layer is small relative to an electric potential measurable between the pair of electrodes.

19. An ultrasonic probe as in claim 17 wherein a dielectric constant measurable between the respective pair of electrodes is substantially the same as that which is intrinsic to the piezoelectric ceramic material of the body.

20. An ultrasonic probe as in claim 13 wherein:

the bulk remainder of the piezoelectric ceramic material is sufficiently poled so as to be substantially electromechanically active; and the weakly poled piezoelectric ceramic layer is substantially electromechanically inert.

21. A probe as in claim 12 wherein the means for controlling the acoustic impedance of the piezoelectric ceramic layer comprises a number of grooves disposed on a surface of the body, the number of grooves being within a range of approximately 50 to 200 grooves.

* * * * *